US006803709B2

(12) United States Patent
Kato et al.

(10) Patent No.: US 6,803,709 B2
(45) Date of Patent: Oct. 12, 2004

(54) DIRECTLY-HEATED OXIDE CATHODE AND FLUORESCENT DISPLAY TUBE USING THE SAME

(75) Inventors: Masahiro Kato, Mobara (JP); Tomohiro Yamada, Mobara (JP)

(73) Assignee: Futaba Corporation, Chiba-ken (JP)

( * ) Notice: Subject to any disclaimer, the term of this patent is extended or adjusted under 35 U.S.C. 154(b) by 57 days.

(21) Appl. No.: 10/272,412

(22) Filed: Oct. 14, 2002

(65) Prior Publication Data

US 2003/0071561 A1 Apr. 17, 2003

(30) Foreign Application Priority Data

Oct. 15, 2001 (JP) ..... 2001-317360

(51) Int. Cl.[7] ..... H01J 1/14
(52) U.S. Cl. ..... 313/346 R; 313/341; 313/345
(58) Field of Search ..... 313/495, 341, 313/345, 346 R, 346 DC

(56) References Cited

FOREIGN PATENT DOCUMENTS

| | | | |
|---|---|---|---|
| EP | 0263483 A1 | 4/1988 | |
| EP | 0470631 A2 | 2/1992 | |
| EP | 0544189 A1 | 6/1993 | |
| JP | 520127151 A | 10/1977 | |
| JP | 60-063848 A | 4/1985 | ..... H01J/9/04 |
| JP | 07-078548 A | 3/1995 | ..... H01J/1/14 |
| JP | 070078548 A | 3/1995 | |

*Primary Examiner*—Vip Patel
(74) *Attorney, Agent, or Firm*—Quarles & Brady LLP

(57) ABSTRACT

A directly-heated oxide cathode and a fluorescent display tube using the same, which works with low power consumption, is provided. In a filament cathode, an alkaline earth oxide having an average grain size of 0.1 $\mu$m to 2.0 $\mu$m is coated in a thickness of 0.5 $\mu$m to 4.0 $\mu$m on the surface of a core metal wire. This structure reduces the power consumption of the filament cathode. The filament cathodes mounted in a fluorescent display tube can reduce the power consumption of the fluorescent display tube.

22 Claims, 12 Drawing Sheets

(φ=29.5μm, ×1000)

(φ=29.5μm, ×3000)

(φ = 32.5 μm, ×1000)

(φ = 32.5 μm, ×3000)

(φ=32.5μm、×1000)

(φ=32.5μm、×3000)

(φ = 37.5 μm, ×1000)

(φ = 37.5 μm, ×3000)

DIRECTLY-HEATED OXIDE CATHODE AND FLUORESCENT DISPLAY TUBE USING THE SAME

BACKGROUND OF THE INVENTION

The present invention relates to directly-heated oxide cathodes, which are used for fluorescent display tubes, light source units, embodying the principle of a fluorescent display tube, for large screen display, light sources for printers, and self-luminous devices for back-lighting. Particularly, the present invention relates to directly heated oxide cathodes, each which has good emission characteristics and low power consumption, and to fluorescent display tubes employing the same.

FIG. 22 is a perspective view illustrating a fluorescent display tube 1. FIG. 23 is a cross-sectional view illustrating the fluorescent display tube shown in FIG. 22. The fluorescent display tube 1 has a triode tube structure. A vacuum vessel is formed of an insulating glass substrate 2, a front glass 30, and a spacer glass 31. The vacuum vessel contains an anode electrode 24, a grid electrode 4 and filament cathodes 5 each acting as a directly heated oxide cathode. A through hole 22 is formed in the upper surface of the wiring layer 21 laminated over the upper surface of the insulating substrate. A conductive material 23 is buried in the through hole 22. The anode electrode 24 is laminated on the upper surface of the insulating layer via the conductive material. The filament cathodes 5, each of which emits thermal electrons, are arranged and supported by filament anchors. Electrical signals are externally supplied to the anode electrodes, the grid electrodes and the filament cathodes via the lead pins 6.

In order to fabricate the filament cathode 5, mixed carbonate powders 52 of alkaline earth metals (e.g. barium (Ba), strontium (Sr) and calcium (Ca)) are coated in a thickness of several $\mu$m and on the surface of a very fine core metal wire 51 (e.g. tungsten or rhenium tungsten) of a diameter of 5 to 41 $\mu$m. The filament cathodes 5 are disposed in the vessel of the fluorescent display tube. Thereafter, while the vessel is being evacuated in vacuum, the filaments are electrically heated to convert them into oxides. Thus, each directly heated oxide cathode is formed as an electron emissive source.

In the fluorescent display tube 1, the electrons emitted from the filament cathodes 5, which are accelerated by means of the grid electrode 4, impinge against the fluorescent substance layer 25 formed on the anode electrode 24. The accelerated electrons excite the fluorescent substance layer 25, light thus emitting from it.

In order to emit light from the fluorescent substance layer effectively, it is required that the filament cathode 5 has an improved emission capability and a reduced power consumption.

Generally speaking, when an oxide cathode is heated, the thermal electron flow (saturated current) per time emitted from the surface thereof is expressed by the following Richardson-Dushmann equation.

$$I_s = SAT^n \exp\left(-\frac{e\phi}{kT}\right) \tag{1}$$

where $I_s$ is a saturated current (a maximum current (A) derived from a material at a temperature);

S is a thermal electron emission area ($cm^2$) of a cathode;

A is a thermal electron emission constant ($A/cm^2K^n$) (either $T^2$ in equation and $K^2$ in units or $T^n$ in equation and $K^n$ in units so that the units balance in the equation);

T is the temperature of a cathode (K);

e is an electron charge;

$\phi$ is the work function (eV); and k is the Boltzmann's constant.

As apparent from the equation, in order to increase the saturated current density $I_s$, there are three requirements: (1) higher cathode temperature, (2) larger thermal emission area and (3) smaller work function.

The work function $\phi$ is a value inherent value determined by the electron emissive material and by the fabrication method. When it is assumed that the work function $\phi$ of a ternary oxide of (Ba, Sr, Ca)O is about 0.9 eV and is constant for respective fluorescent display tubes, it is understood that increasing the thermal electron emission area S of the cathode and increasing the cathode temperature T can result in improving the cathode's emission capability.

The thermal emission area S can be widened by increasing the oxide coating amount, that is, the coating thickness. However, because an increase of the oxide coating amount causes an increase of the radiant heat from the surface of the oxide cathode, the temperature affecting the emission capability may be decreased.

Some prior art publications disclose techniques in consideration of the above-mentioned problems. According to Japanese Patent Laid-open Publication No. 9-148066, the electron emissive area corresponds to the surface area of a filament cathode, on which a ternary oxide is coated. The ternary oxide, formed of barium, strontium and calcium, has a thickness of 6.5 to 7.5 $\mu$m, so that a good emission capability can be obtained with a fixed power consumption and in a good balanced state.

Japanese Patent Laid-open Publication No. 60-63484 discloses a method of producing a pure oxide cathode, of which the grain size (diameter) is reduced, having good emission characteristics. This method includes the steps of making grains (or particles) of carbonate of alkaline earth metal while stirring and reacting an ammonium carbonate aqueous solution in a nitrate aqueous solution of an alkaline earth metal (such as barium (Ba), strontium (Sr) and calcium (Ca)) at high-velocity revolution; making an electro-deposit solution while mixing and dispersing the alkaline metal carbonate, a bonding agent, and an organic solvent; disposing, within a vessel, filament cathodes each formed of a tungsten (W) core wire having the surface on which the carbonates are deposited using the electro-deposit solution; and thermally decomposing the ternary carbonate, made of an alkaline earth metal, while evacuating the vessel in vacuum.

Because of the recent demand for energy saving, it has been required to reduce the consumption power of a fluorescent display tube. The problem of the present invention is to reduce the power consumed by the filament cathode, corresponding to 50% to 70% of the power consumption of a fluorescent display tube, and to reduce the power consumption of a fluorescent display tube using filament cathodes.

The inventors in the present application studied devotedly to reduce the power consumption of the fluorescent display tube. As a result, the inventors found that uniformly coating fine ternary carbonate particles on the surface of a core metal wire allows the power consumption of the filament cathode to be reduced.

Moreover, the inventors found that the power consumption consumed by the filament cathodes, corresponding to 50% to 70% of the total power consumption of a fluorescent display tube, can be reduced by using the filament cathode of the present invention.

SUMMARY OF THE INVENTION

The present invention is made to solve the above-mentioned problems.

An object of the invention is to provide a directly heated oxide cathode which has good emission characteristics and reduced power consumption.

Another object of the present invention is to provide a fluorescent display tube, which employs the above-mentioned cathode.

An aspect of the present invention relates to a directly heated oxide cathode in which an electron emissive material having a thickness of 0.5 μm to 4.0 μm is formed on a surface of a core metal wire.

Another aspect of the present invention relates to a directly-heated oxide cathode in which a solid solution of an electron emissive material formed of oxide crystal grains each having an average grain size of 0.1 μm to 2.0 μm is coated on a surface of a core metal wire.

A further aspect of the present invention relates to a directly-heated oxide cathode in which an electron emissive material is coated on a surface of a core metal wire, the electron emissive material being a solid solution formed of grains each having an average grain size of at least 0.1 μm to 2.0 μm, the electron emissive material having an average thickness of 0.5 μm to 4.0 μm.

A still further aspect of the present invention relates to a directly-heated oxide cathode in which an electron emissive material is coated on a surface of a core metal wire, the electron emissive material being formed of oxide crystal grains formed of carbonate particles each having an average grain size of at least 0.1 μm to 2.0 μm.

In the directly heated oxide cathode, the core metal wire comprises a tungsten core wire or a rhenium tungsten core wire.

In the directly heated oxide cathode, the electron emissive material comprises a ternary oxide formed of at least barium, strontium and calcium.

In the directly heated oxide cathode, the electron emissive material comprises a ternary oxide in which the weight ratio of barium (Ba), strontium (Sr) and calcium (Ca) is at least Ca:Sr:Ba=(5 to 25):(25 to 60):(30 to 60).

Still another aspect of the present invention relates to a fluorescent display tube including as a thermionic source the directly heated oxide cathode according to the present invention.

BRIEF DESCRIPTION OF THE DRAWINGS

This and other objects, features, and advantages of the present invention will become more apparent upon a reading of the following detailed description and drawings, in which.

DESCRIPTION OF THE EMBODIMENTS

In order to make a filament, first, an alkaline earth metal carbonate (Ba, Sr, Ca) $CO_3$ is electro-deposited on a tungsten core wire of a diameter of 5 to 41 μm, together with an acrylic organic binder.

When a mixed solution of $Ba(NO_3)_2$, $Sr(NO_3)_2$ and $Ca(NO_3)_2$, each well-refined, is added to a solution of $Na_2CO_3$ or $(NH_4)_2CO_3$, the following reaction, for example, occurs.

$$(Ba, Sr, Ca)(NO_3)_2+Na_2CO_3 \rightarrow (Ba, Sr, Ca)CO_3+2NaNO_3 \quad (2)$$

Through this reaction, the carbonate (Ba, Sr, Ca) $CO_3$ is white-precipitated. Carbonate is obtained by sufficiently washing the sediment with warm water.

At the stage of ending the evacuation step in a fluorescent display tube assembly process, the carbonate is electrically heated at about 1000° C. in vacuum. Thus, the organic binder is decomposed and vaporized while being thermally decomposed into oxides through the following reaction.

$$3(Ba, Sr, Ca)CO_3 \rightarrow 3CO_2+3(Ba, Sr, Ca)O \quad (3)$$

At this time, part of BaO molecules are reduced by means of a tungsten core wire being a base metal while the following reaction occurs.

$$BaO \rightarrow Ba+(½)O_2\uparrow \quad (4)$$

Thus, free Ba atoms are produced and act as electron emissive sources.

The chemical reaction (4) occurs on the interface between the core metal wire and BaO. Thus, free Ba atoms are created through the reduction of BaO. The present inventors presumed that Ba atoms act as electron emitters and the ternary carbonate, densely deposited onto the surface of the fine tungsten wire, provides a sufficient electron emission capability even when the coating amount is small. Moreover, it was assumed that the free Ba atoms can reduce the reactive power consumption of the filament cathode, caused by the thickness of the ternary carbonate.

In further assumption of the inventors, the ternary carbonate deposited densely on the core metal wire provides a sufficient emission capability even when the amount thereof is small. Reduction of the radiant heat from the oxide cathode surface caused by an increased amount of coated oxide can lead to fabrication of a filament cathode having low power consumption. The present inventors confirmed the above assumptions as follows:

(Ba, Sr, Ca) of 3.0 μm particles (D90=8.22, D50=3.00, D10=1.15), 2.0 μm particles (D90=5.62, D50=2.00, D10=0.20), and 0.5 μm particles (D90=2.32, D50=0.50, D10=0.04) is prepared as a ternary carbonate used for a filament cathode. The ternary carbonate, an acrylic resin binding agent, and a ketone or alcoholic solvent are mixed together to make an electro-deposit solution.

Figure 3:
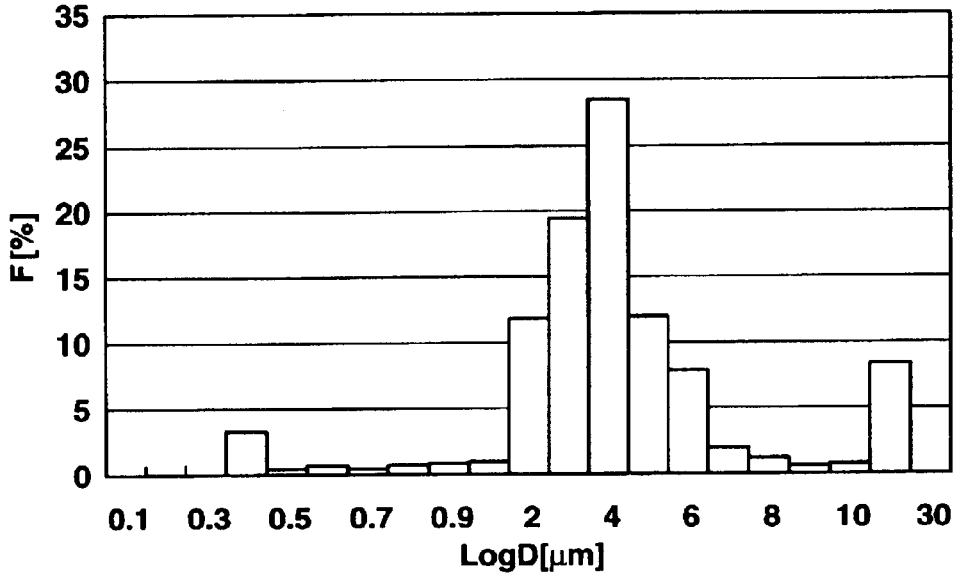
FIG. 3 is a histogram showing a viscosity distribution of 3.0 μm particles of carbonate in a prior art.

As to the 3.0 μm particles (D90=8.22, D50=3.00, D10=1.15), particles with a grain size (diameter) of up to 1.15 μm accounts for 10% of the total, particles with a grain size of up to 3.00 μm accounts for 50% of the total, and particles with a particle diameter of up to 8.22 μm accounts for 90% of the total. The average grain size is 3.00 μm. (FIG. 3 shows a grain size distribution of 3.0 μm particles)

Figure 4:
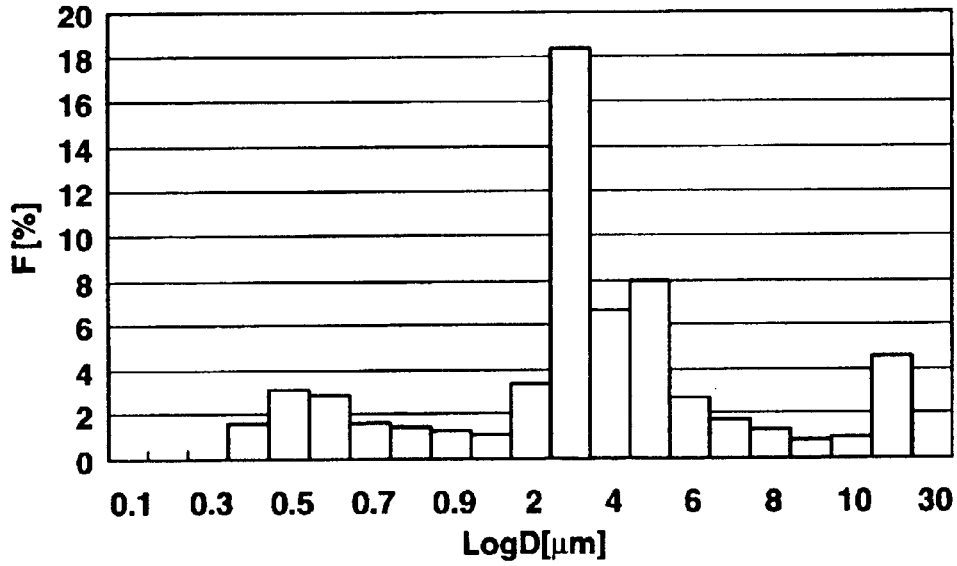
FIG. 4 is a histogram showing a viscosity distribution of 2.0 μm particles of carbonate, used for the present invention.

As to the 2.0 μm particles (D90=5.62, D50=2.00, D10=0.20), particles with a grain size of up to 0.2 μm accounts for 10% of the total, particles with a grain size of up to 2.0 μm accounts for 50% of the total, and particles with a grain size of up to 5.62 μm accounts for 90% of the total. The average grain size is 2.0 μm. (FIG. 4 shows a grain size distribution of 2.0 μm particles)

Figure 5:
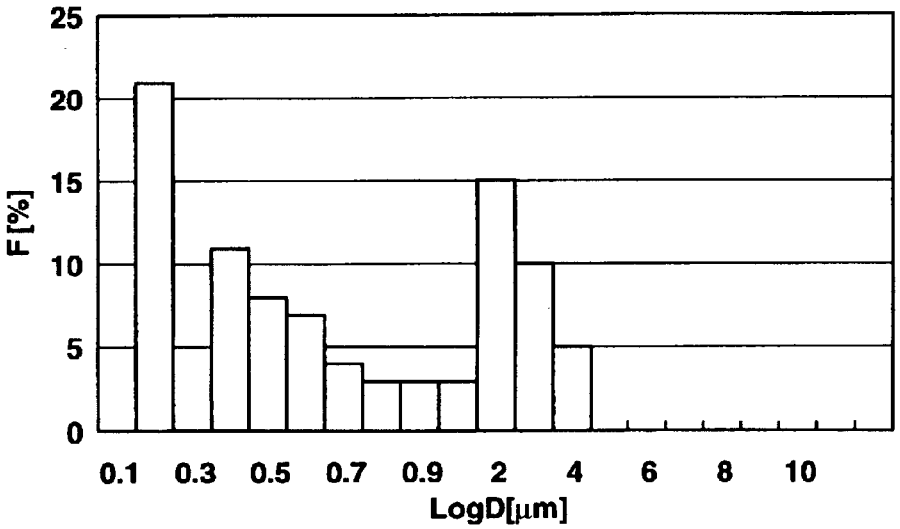
FIG. 5 is a histogram showing a viscosity distribution of 0.5 μm particles of carbonate, used for the present invention.

As to the 0.5 μm particles (D90=2.32, D50=0.50, D10=0.04), particles with a grain size of up to 0.04 μm accounts for 10% of the total, particles with a grain size of up to 0.50 μm accounts for 50% of the total, and particles with a grain size of up to 2.32 μm accounts for 90% of the total. The average grain size is 0.5 μm. (FIG. 5 shows a grain size distribution of 0.5 μm particles)

An electrolysis solution containing 3.0 μm particles, an electrolysis solution containing 2.0 μm particles, and an electrolysis solution containing 0.5 μm particles are prepared. Using these electrolysis solutions, the ternary carbonate is coated in a thickness of 1, 2, 3, 4, 5, 6, 7, or 8 μm and on a 24.5 μm-diameter tungsten core, according to the cataphoresis. Thus, filament cathodes are produced.

The filament cathodes thus formed are disposed in a fluorescent display tube. Each filament cathode is electrically heated at about 1000° C. to decompose the carbonate, while vacuum pumping is being performed. Thus, a fluorescent display tube in which directly-heated oxide cathodes are mounted is fabricated.

Next, an embodiment according to the present invention will be described in more detail.

Production Process of Carbonate:

Raw materials consisting of $Ca(NO_3)_2$ $4H_2O$, $Sr(NO_3)_2$, and $Ba(NO_3)_2$ are weighed in such a way that when the raw material are chemically changed into $CaCO_3$, $SrCO_3$ and $BaCO_3$, the ratio of $CaCO_3$:$SrCO_3$:$BaCO_3$=(5 to 25):(25 to 60):(30 to 60) by weight ratio is obtained.

After the nitrate (salt) is stirred and dissolved in water, it is filtrated to remove solid materials, so that only the aqueous solution remains.

Moreover, the material, $(NH_4)_2CO_3$ $H_2O$, is stirred and dissolved in water, and then filtrated, so that an aqueous solution is obtained.

Nitrate aqueous solution of an alkaline earth metal and ammonium carbonate aqueous solution are reacted together while being stirred and mixed at a high-velocity revolution of 1000 or more revolutions per minute. Thus, an alkaline earth metal carbonate (ternary carbonate) is made. The reaction under high-velocity revolution enables the formation of small crystals because the growth of crystal is blocked. The ternary carbonate is rinsed, dehydrated, and dried. Thus, particles of pure ternary carbonate are produced.

Production Process of Binding Agent:

The binding agent reinforces the adhesive strength of ternary carbonate after electro-deposition. An acrylic resin or cellulosic ester is used as the binding agent. In the present embodiment, an acrylic resin was used. For example, the binding agent is prepared by mixing and drying Acrypet VH (manufactured by Mitsubishi Rayon Co., Ltd.) and Acrypet VHK (manufactured by Mitsubishi Rayon Co., Ltd.) and then dissolving the mixture into acetone.

Production Process of Electro-Deposit Solution:

The concentrated solution, which is prepared by mixing the carbonate, the binding agent, acetone, and isopropyl alcohol, is prepared and stored. In use, a binding agent is mixed with a solvent, such as acetone, methyl isopropyl alcohol or isopropyl alcohol to create an electro-deposit solution. Thus, an electro-deposit solution is prepared.

Different electro-deposit solution contents thus produced are adjustably mixed together to produce an electro-deposit solution of a specific gravity of 0.8 to 0.9.

Figure 1:
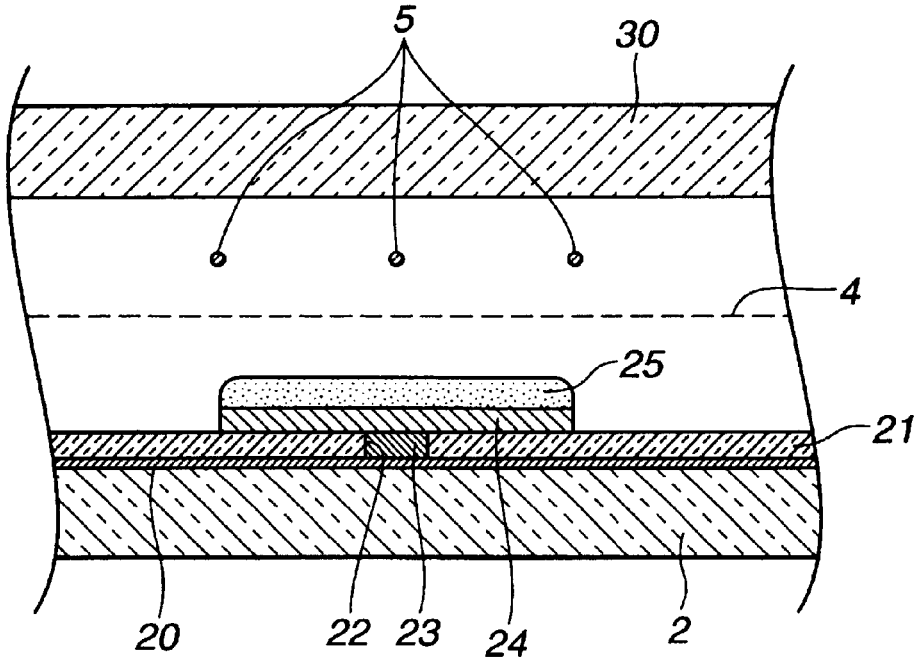
FIG. 1 is an enlarged side sectional view partially illustrating a fluorescent display tube embodying a filament cathode according to an embodiment of the present invention.
Figure 2:
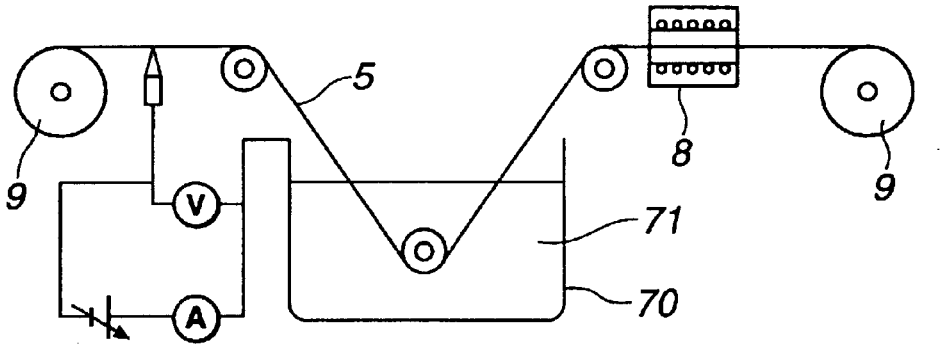
FIG. 2 is a diagram illustrating an electro-depositing apparatus for fabricating filament cathodes according to the embodiment of the present invention.

Electro-Deposit Process:

The electro-deposit solution 71 is put into the electro-deposit bath, as shown in FIG. 2. A positive dc voltage (+) is applied to the electro-deposit solution 71 while a negative dc voltage (−) is applied to the fine tungsten wire 5. This structure continuously passes through the electro-deposit solution 71. On the principle of a cataphoresis, both the ternary oxide and the binding agent can be electro-deposited on the surface of the tungsten core wire 51 as shown in FIGS. 18–21. Numeral 8 represents a heater. Numeral 9 represents a spool.

The electro-deposit solution 71 in the bath 70 is circulated and dispersed by the pump to electro-deposit uniformly it on the tungsten core wire 51.

Assembly Process:

The tungsten core wire 51 acting as a cathode, on which the ternary carbonate 52 and the binding agent are electro-deposited, are securely bonded and stretched with the filament anchors and the filament supports in a fluorescent display tube.

Thereafter, the vessel is evacuated in vacuum.

At the final stage of the evacuation process, the cathode voltage is applied to the cathode to heat the tungsten core wire while vacuum pumping the vessel.

As a result, the ternary carbonate deposited on the surface of the tungsten core wire is thermally decomposed. Oxide and carbon dioxide gas are created through the chemical reaction (3) while the carbon dioxide gas is exhausted out. The oxides of Ba, Sr and Ca are coated on the surface of the fine tungsten wire. The binding agent is converted into $CO_2$ through the thermal decomposition while $CO_2$ gases are exhausted out.

Using the electro-deposit solutions of three types containing a ternary carbonate of 3.0 μm particles, a ternary carbonate of 2.0 μm particles, and a ternary carbonate of 0.5 μm particles, filament cathodes are prepared, on each of which an oxide having a thickness of 0.5, 1, 2, 3, 4, 5, 6, 7, or 8 μm is coated on a core tungsten wire according to the cataphoresis.

As to the 3.0 μm particles, because particles each having a grain size of up to 1.15 μm account for 10% for the total, the thickness of the electron emissive substance layer can be set to up to 1.15 μm. As to the 2.0 μm particles, because particles each having a grain size of up to 0.2 μm account for 10% of the total, the thickness of the electron emissive substance layer can be set to up to 0.2 μm. As to the 0.5 μm particles, because particles each having a grain size of up to 0.04 μm account for 10% the total, the thickness of the electron emissive substance layer can be set to up to 0.04 μm.

Fluorescent display tubes in which the above-produced filament cathodes are mounted are fabricated and evaluated as follows:

The same conditions are applied to elements, except the filament cathodes. The fluorescent substance used for the fluorescent substance layer is a fluorescent substance ZnO:Zn for low-rate electron beam scanning. Plural round patterns, each which has a diameter of 4.0 mm, are arranged.

Figure 6:
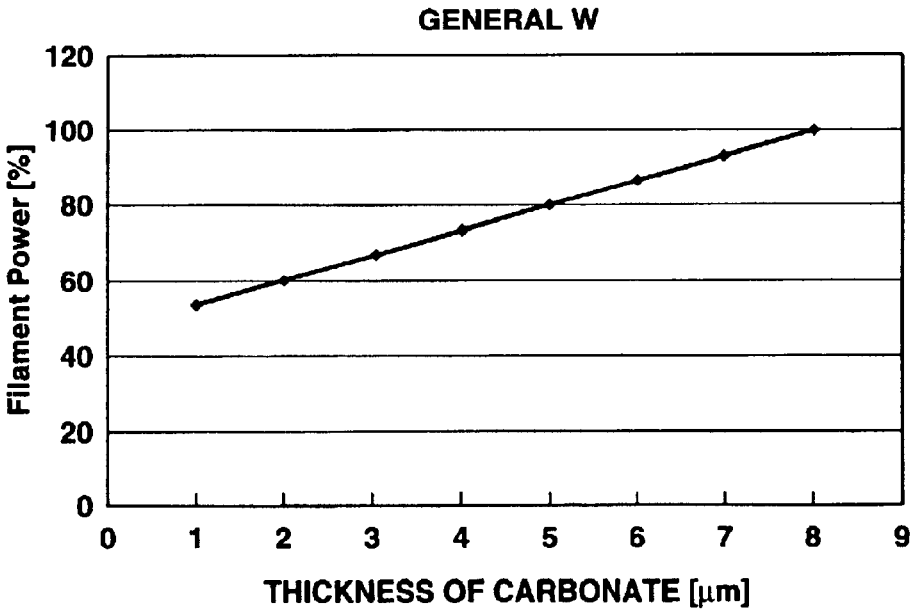
FIG. 6 is a graph plotting the filament power consumption of a fluorescent display tube using filament cathodes according to the present invention.

Measurement of Power Consumption of Filament Cathode:

FIG. 6 shows a relationship between filament power consumption and carbonate film thickness. In FIG. 6, a voltage is applied across the filament to maintain at 645° C. the surface temperature of a filament cathode, on which carbonate particles each having an average grain size of 0.5 μm are coated. At that time, the filament current values are measured.

Referring to FIG. 6, the power consumption increases proportionally to the thickness of the ternary carbonate coated on the tungsten fine wire.

It was ascertained that the thinner the carbonate, the lower the power consumption.

By subjecting a tungsten core wire in the electro-deposit solution containing the ternary carbonate of 3.0 μm particles to cataphoresis, filament cathodes on each of which an oxide is coated in a thickness of 0.5, 1, 2, 3, 4, 5, 6, 7, or 8 μm are fabricated. In this case, an oxide having a thickness of up to 1.15 μm can be coated on the tungsten wire. However, an oxide having a thickness of 3 μm or less could not be uniformly coated on the tungsten wire.

When a voltage is applied across the filament cathode to maintain the surface temperature thereof at 645° C., the filament current value is measured. Thus, the filament power consumption is obtained. Until the grain size is up to 3 μm, the measurement results are similar to the filament power consumption characteristic of a fluorescent display tube using filament cathodes each on which the 0.5 μm particle oxide is coated, shown in FIG. 6.

By subjecting a tungsten core wire in the electro-deposit solution containing the ternary carbonate of 2.0 μm particles to cataphoresis, filament cathodes on each of which an oxide is coated in a thickness of 0.5, 1, 2, 3, 4, 5, 6, 7, or 8 μm are fabricated. However, when the thickness of an oxide is 2 μm or less, the oxide is not be uniformly coated on the tungsten wire.

When a voltage is applied across the filament cathode to maintain the surface temperature thereof at 645° C., the filament current value is measured. Thus, the filament power consumption is measured. Until the grain size is up to 2 μm in diameter, the measurement results are similar to the filament power consumption characteristic of a fluorescent display tube using filament cathodes each on which the 0.5 μm particle oxide is coated, shown in FIG. 6.

Figure 7:
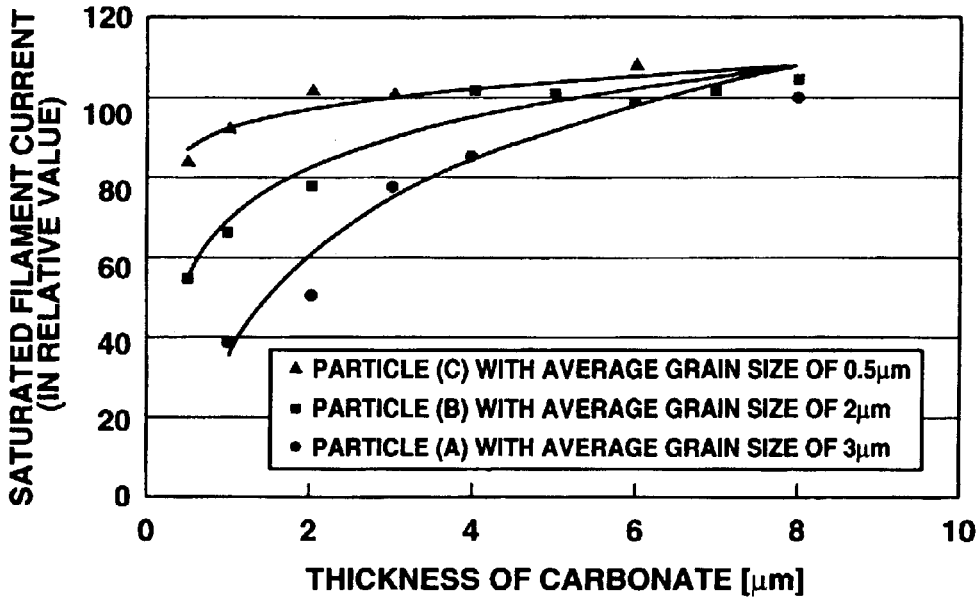
FIG. 7 is a graph plotting the filament saturated current of a fluorescent display tube using filament cathodes according to the present invention.

Measurement of Saturated Filament Current:

As to the same samples, the filament cathode is maintained at the surface temperature of 377° C. The filament current is maintained to a fixed value. Each of the grid voltage and the anode voltage is 100 VDC, respectively. The pulse width is 100 μS. The duty Du is 1/300. Under such conditions, saturated filament current value measurements are shown in FIG. 7.

With the 3.0 μm ternary oxide particles (A), the saturated filament current of a ternary oxide film having a thickness of 4 μm drops to about 85% or less of the saturated filament current of a ternary oxide film having a thickness of 6.5 to 7.5 μm. The saturated filament current of a ternary oxide film having 3 μm drops to about 77% or less. The saturated filament current of a ternary oxide film having 2 μm drops to about 50% or less. Therefore, the ternary oxide film having a thickness of 4.0 μm or less cannot be put in practical use.

With the 2.0 μm ternary oxide particles (B), the saturated filament current of a ternary oxide film having an average thickness of 3 μm is about 100% of the saturated filament current of the ternary oxide film having a thickness of 6.5 to 7.5 μm. The saturated filament current of a ternary oxide film having a thickness of 2 μm drops to about 77% or less. It is difficult to put the ternary oxide having an average thickness of 2 μm or less in practical use. However, the ternary oxide having an average thickness of 3.0 μm or more can be put in practical use.

With the 0.5 μm ternary oxide particles (C), the saturated filament current of a ternary oxide film having a thickness of 4 μm is about 100% to the saturated filament current of a ternary oxide film having a thickness of 6.5 to 7.5 μm. The saturated filament current at a ternary oxide film having a thickness of 2 μm is 100% to the saturated filament current of the ternary oxide film having a thickness of 6.5 to 7.5 μm. The saturated filament current at a ternary oxide film having a thickness of up to 1 μm is 92%. However, by referring to the saturated current residual ratio characteristics shown in FIG. 9, at a film thickness of up to 1.0 μm, good saturated filament current residual ratio characteristics can be expected, compared with the characteristics of the conventional fluorescent display tube.

As described above, finer carbonate particles can be deposited more densely on the tungsten core wire and can provide the sufficient saturated filament current. Therefore, it can be ascertained that the ternary carbonate can be thinly coated.

Figure 8:
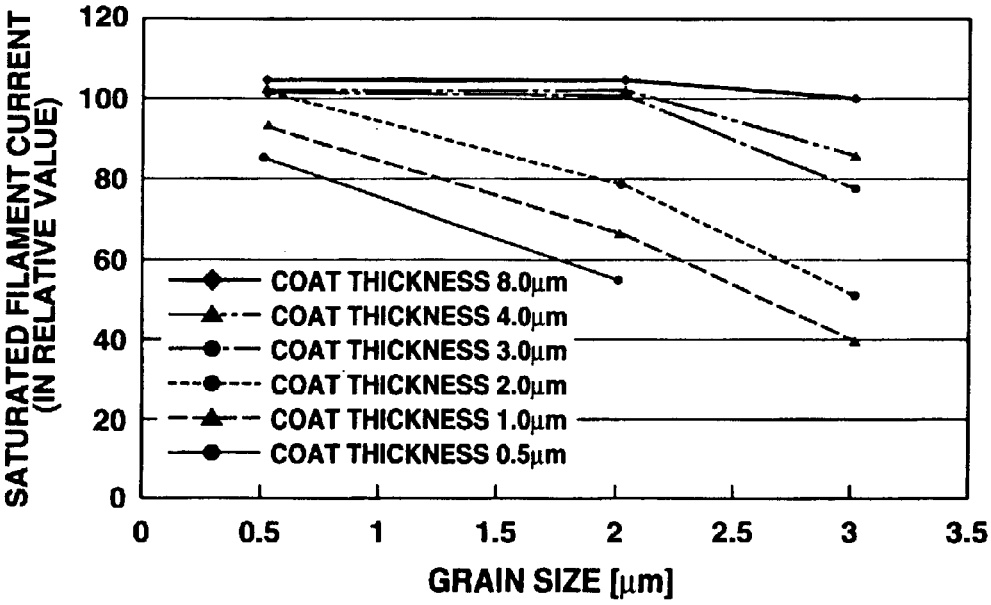
FIG. 8 is a graph plotting saturated-current residual rates of a fluorescent display tube using filament cathodes according to the present invention.

Fluorescent display tubes in which filament cathodes, each being coated with a carbonate, are mounted are prepared. The carbonate has an average grain size of 0.5 μm, 2.0 μm, or 3.0 μm. The carbonate is coated to have a thickness of 0.5 μm, 1.0 μm, 2.0 μm, 3.0 μm, or 4.0 μm. Each filament cathode is maintained to a surface temperature of 377° C. The filament current is maintained to a fixed value. Each of the grid voltage and the anode voltage is set to 100 VDC. The pulse width is set to 100 μS. The duty Du is set to 1/300. Under such conditions, the filament current values are measured. FIG. 8 shows the graph plotting filament current measurements, compared with those of a fluorescent display tube which includes fluorescent cathodes each on which a carbonate layer having a thickness of 8.0 μm is coated.

Consequently, decreasing the average grain size of carbonates allows the carbonates to be densely deposited on the tungsten core wire and the saturated filament current to be sufficiently provided. The serviceable life of the fluorescent display tube depends on the brightness residual rate compared to an initial brightness. However, because the serviceable life largely depends on the filament cathode saturated current residual rate of a fluorescent display tube, a longer serviceable life than that in the prior art can be expected.

Therefore, the thickness of the ternary oxide film can be thinned. It is ascertained that when the average grain size exceeds 3 μm, the carbonate layer cannot be thinned.

Figure 9:
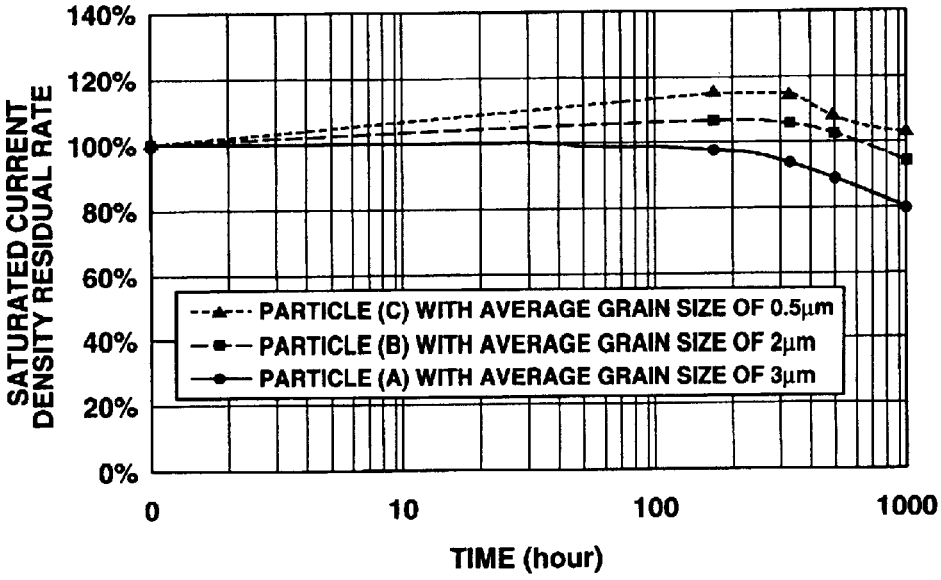
FIG. 9 is a graph plotting saturated-current residual rates of a fluorescent display tube using filament cathodes according to the present invention.

Measurement of Saturated Current Residual Rate:

Moreover, regarding the same samples, FIG. 9 shows changes of the saturated current residual rate. Referring to FIG. 9, a voltage is applied across the filament cathode to set the surface temperature thereof to 645° C. The fluorescent substance used for a fluorescent substance layer corresponds to a fluorescent substance ZnO:Zn for low-rate electron beam scanning. Thus, the fluorescent display tube is continuously emitted for 1000 hours under the condition where round patterns each having a diameter of 4.0 mm are light-emitted at 1000 (cd/m$^2$).

The graph (A) plots ratios of saturated current values per time to an initial saturated current when a fluorescent display tube using conventional filament cathodes (each on which 3.0 μm particles are coated in a thickness of 8 μm) was continuously lighted for 1000 hours.

The graph (B) plots ratios of saturated current values per time to an initial saturated current when a fluorescent display tube using a filament cathodes (each on which 2.0 μm particles are coated in a thickness of 3 μm) according to the present invention was continuously lighted for 1000 hours.

The graph (C) plots ratios of saturated current values per time to an initial saturated current when a fluorescent display tube using a filament cathodes (each on which 0.5 μm particles are coated in a thickness of 1 μm) according to the present invention was continuously lighted for 1000 hours.

These graphs indicate that an electron emissive material coated densely and thinly on a filament cathode provides a good saturated current rate.

The operational life of a fluorescent display tube depends on a brightness residual rate to an initial brightness. The saturated current residual rate of a filament cathode of the fluorescent display tube acts as a factor of the operational life. Hence, an operational life longer than that in a prior art can be expected.

The states of the ternary carbonates coated on tungsten core wires in filament cathodes according to the present invention were observed under an electron microscope.

Figure 10:
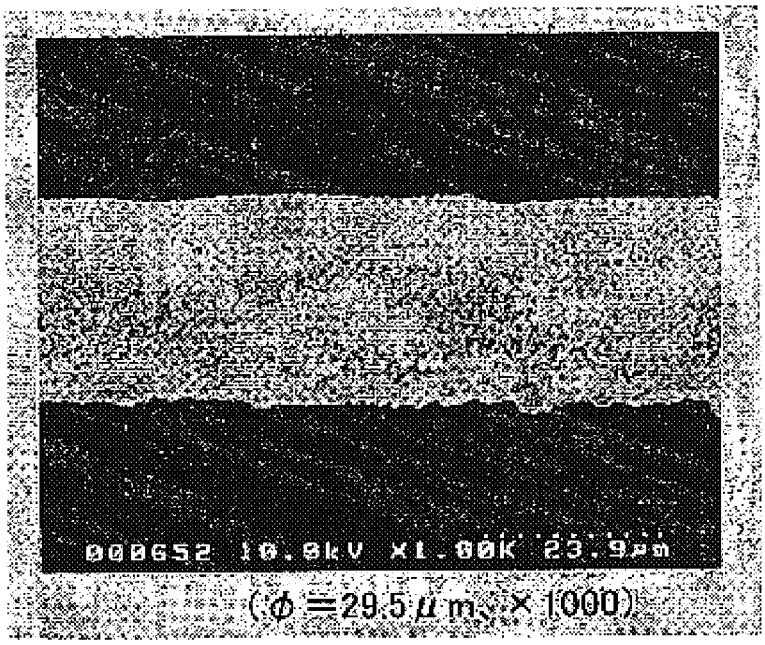
FIG. 10 is a photograph (×1000) of a filament cathode according to the present invention, in which 0.5 μm particles are coated to a thickness of 2.5 μm.

FIG. 10 shows a SEM image (an electron micrograph magnified 1000 times) in which an electron emissive material of 0.5 μm particles is coated to an average thickness of 2.5 μm on a 24.5 μm diameter tungsten core wire.

Figure 11:
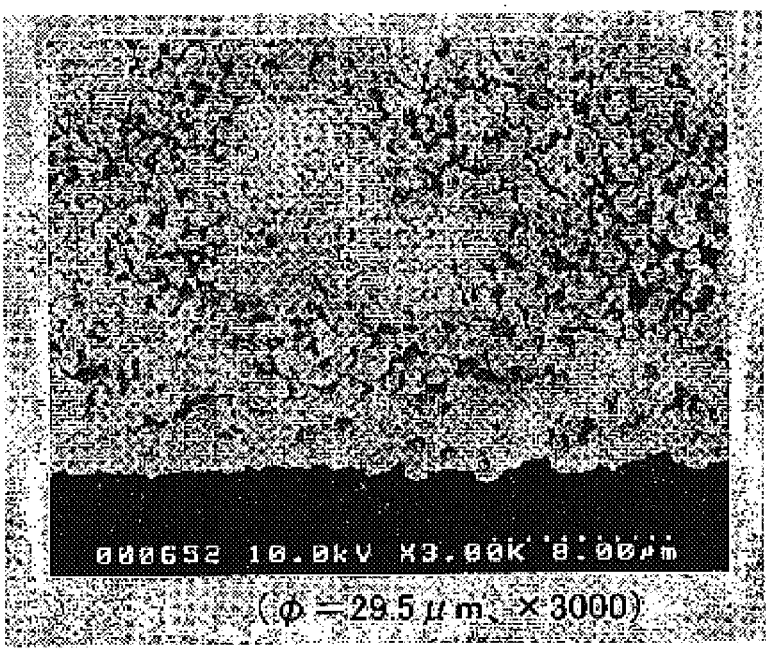
FIG. 11 is a photograph (×3000) of a filament cathode according to the present invention, in which 0.5 μm particles are coated to a thickness of 2.5 μm.

FIG. 11 shows a SEM image (an electron micrograph magnified 3000 times) in which an electron emissive material of 0.5 μm particles is coated to an average thickness of 2.5 μm on a 24.5 μm diameter tungsten core wire.

These micrographs show electron emissive materials uniformly coated.

Figure 18:
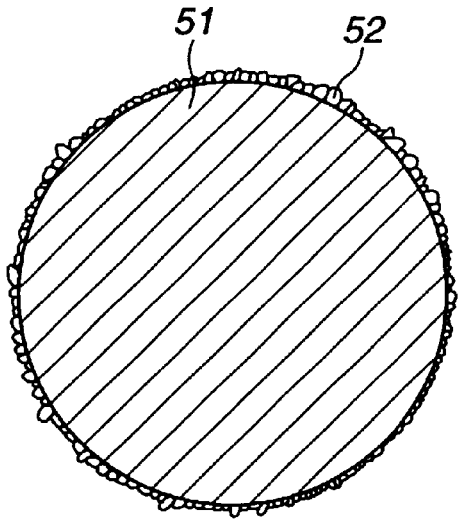
FIG. 18 is a cross-sectional view showing a metal core wire in which a carbonate having a thickness of 0.5 μm is coated in a single layer.

FIG. 18 is a conceptual diagram showing the above-mentioned state. It is supposed that the fine ternary carbonate coated on a tungsten core wire provides a large contact area and effectively emits electrons. FIG. 18 shows a single ternary carbonate layer. However, it can be supposed that multiple ternary carbonate layers can emit electrons more effectively.

Figure 12:
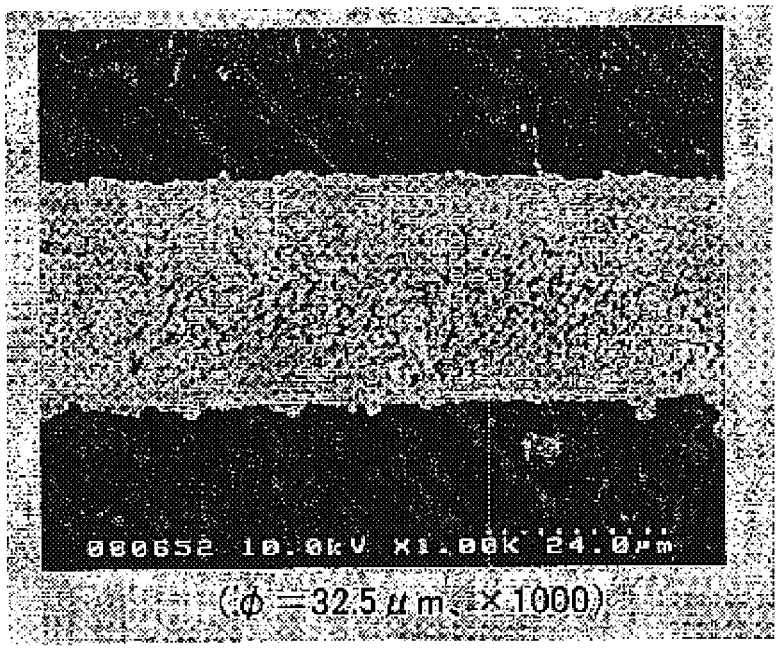
FIG. 12 is a photograph (×1000) of a filament cathode according to the present invention, in which 0.5 μm particles are coated to a thickness of 4 μm.

FIG. 12 shows a SEM image (an electron micrograph magnified 1000 times) in which an electron emissive material of 0.5 μm particles is coated to an average thickness of 4.0 μm on a 24.5 μm diameter tungsten core wire.

Figure 13:
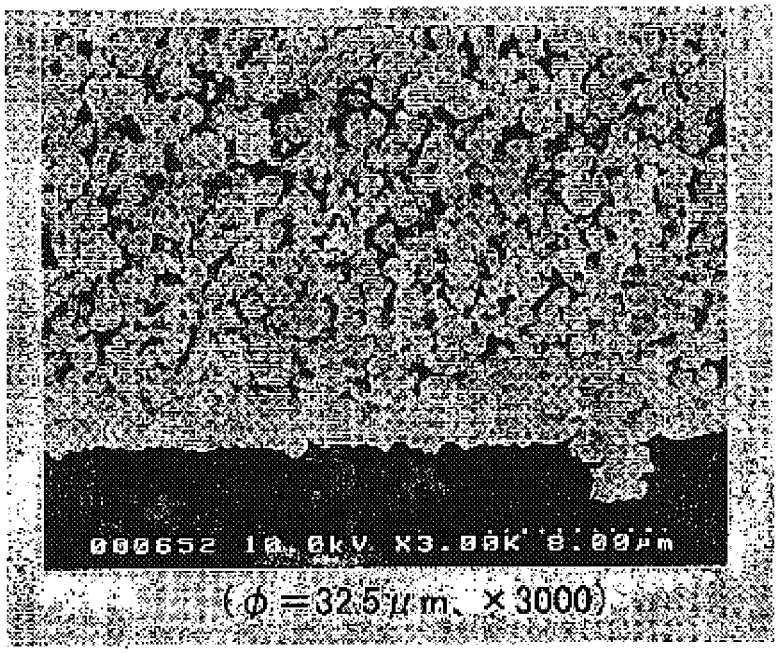
FIG. 13 is a photograph (×3000) of a filament cathode according to the present invention, in which 0.5 μm particles are coated to a thickness of 4 μm.

FIG. 13 shows a SEM image (an electron micrograph magnified 3000 times) in which an electron emissive material of 0.5 μm particles is coated to an average thickness of 4.0 μm on a 24.5 μm diameter tungsten core wire. These micrographs indicate that the electron emissive material is coated uniformly.

There is no conceptual diagram for the above-mentioned state. It can be supposed that the fine ternary carbonate coated on a tungsten core wire (shown in FIG. 18) provides a large contact area and effectively emits electrons.

Figure 14:
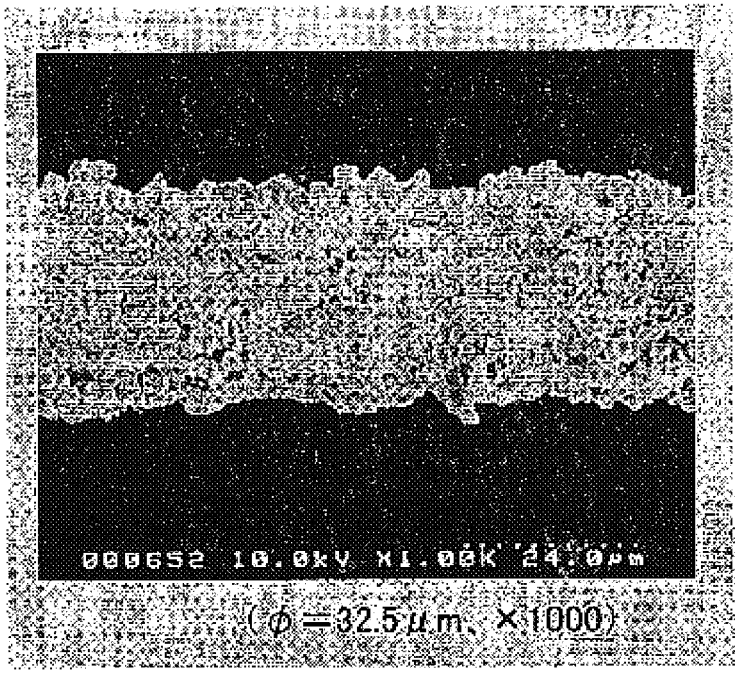
FIG. 14 is a photograph (×1000) of a filament cathode, in which 2.0 μm particles are coated to a thickness of 4 μm.

FIG. 14 shows a SEM image (an electron micrograph magnified 1000 times) in which an electron emissive material of 2.0 μm particles is coated to an average thickness of 4 μm on a 24.5 μm diameter tungsten core wire.

Figure 15:
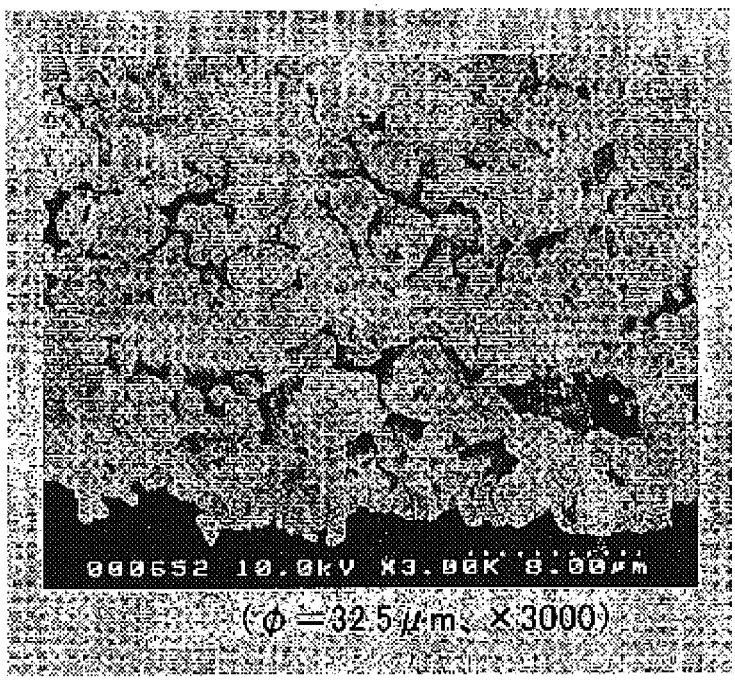
FIG. 15 is a photograph (×3000) of a filament cathode, in which 2.0 μm particles are coated to a thickness of 6.5 μm.

FIG. 15 shows a SEM image (an electron micrograph magnified 3000 times) in which an electron emissive material of 2.0 μm particles is coated to an average thickness of 4 μm on a 24.5 μm diameter tungsten core wire.

The SEM image (an electron micrograph magnified 1000 times) shows a remarkable rough surface of an emissive material. In the SEM image (an electron micrograph magnified 3000 times), the protruded portion is a large particle and the depressed portion is filled with fine electron emissive materials.

Figure 19:
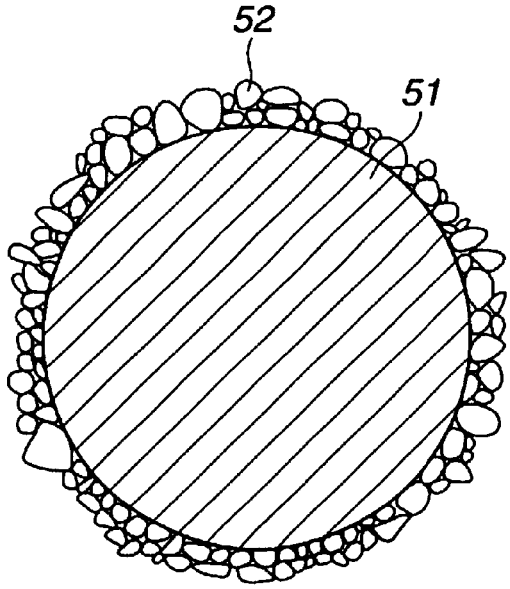
FIG. 19 is a cross-sectional view showing a metal core wire in which a carbonate having a thickness of 2.0 μm is coated in plural layers.

FIG. 19 is a conceptual diagram showing the above-mentioned state. The ternary carbonate become coarse, compared with the 0.5 μm shown in FIG. 18. It can be supposed that the coarse ternary carbonate coated on a tungsten core wire provides a large contact area and effectively emits electrons.

Figure 16:
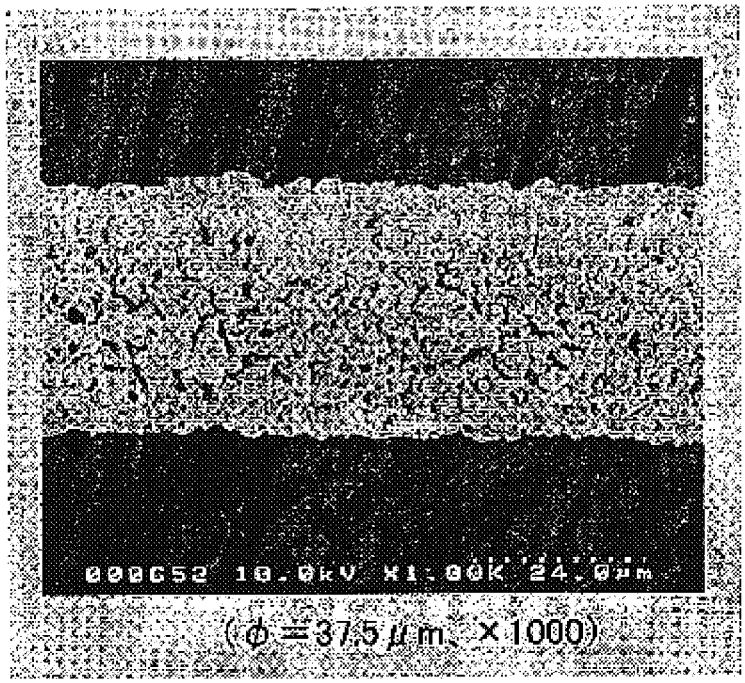
FIG. 16 is a photograph (×1000) of a filament cathode, in which 3.0 μm particles are coated to a thickness of 6.5 μm.

FIG. 16 shows a SEM image (an electron micrograph magnified 1000 times) in which a conventional electron emissive material of 3.0 μm particles is coated to an average thickness of 6.5 μm on a 24.5 μm diameter tungsten core wire.

Figure 17:
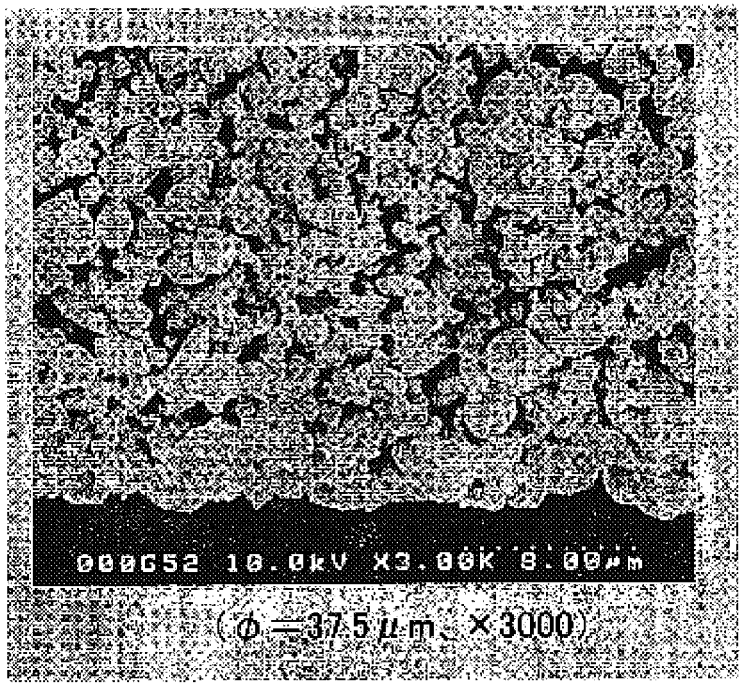
FIG. 17 is a photograph (×3000) of a filament cathode, in which 3.0 μm particles are coated to a thickness of 6.5 μm.

FIG. 17 shows a SEM image (an electron micrograph magnified 3000 times) in which the electron emissive material of 3.0 μm particles is coated in an average thickness of 6.5 μm on a 24.5 μm diameter tungsten core wire.

Figure 20:
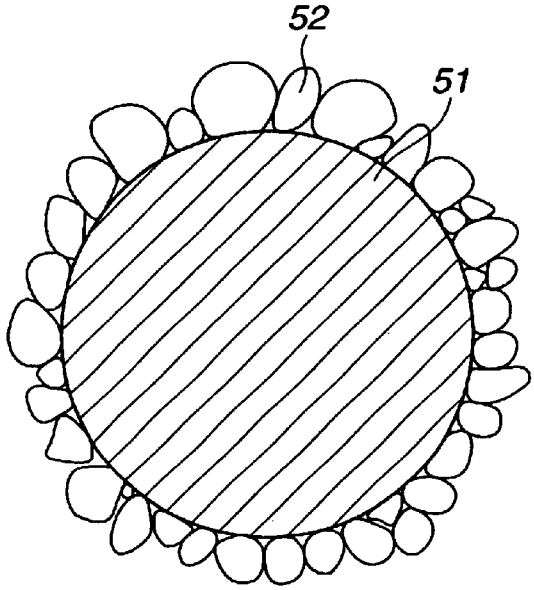
FIG. 20 is a cross-sectional view showing a metal core wire in which a carbonate having a thickness of 3.0 μm is coated in a single layer.
Figure 21:
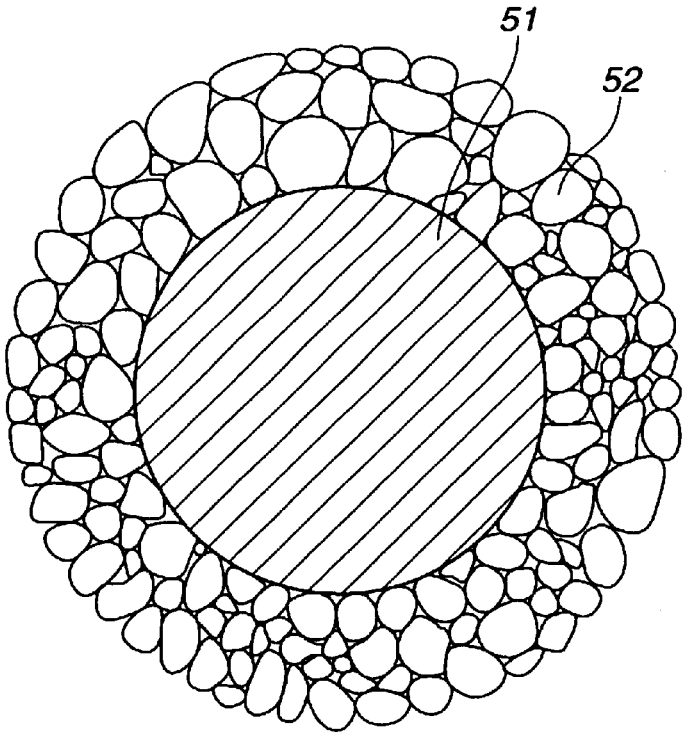
FIG. 21 is a cross-sectional view showing a metal core wire in which a carbonate having a thickness of 3.0 μm carbonate is coated in plural layers.
Figure 22:
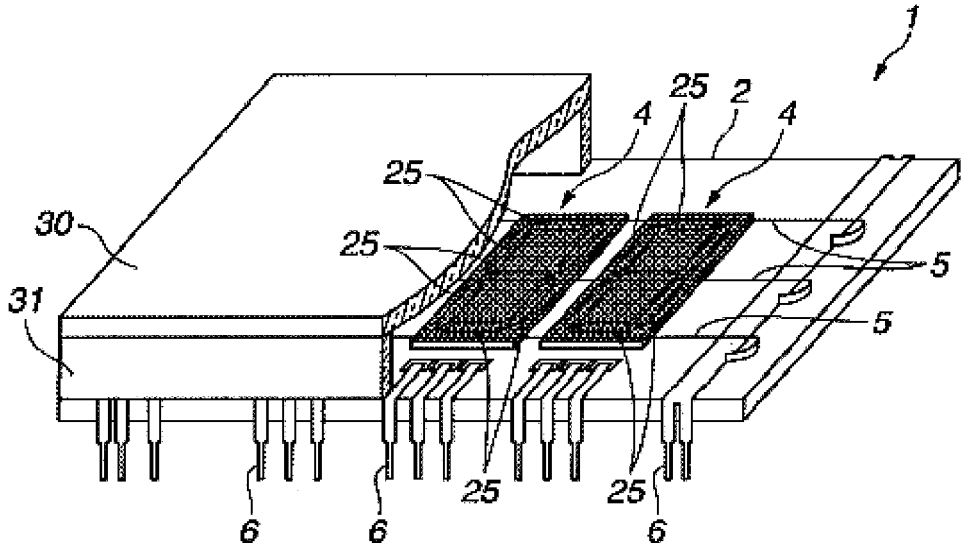
FIG. 22 is a side cross-sectional view, partially broken, illustrating a fluorescent display tube on which conventional filament cathode are mounted.
Figure 23:
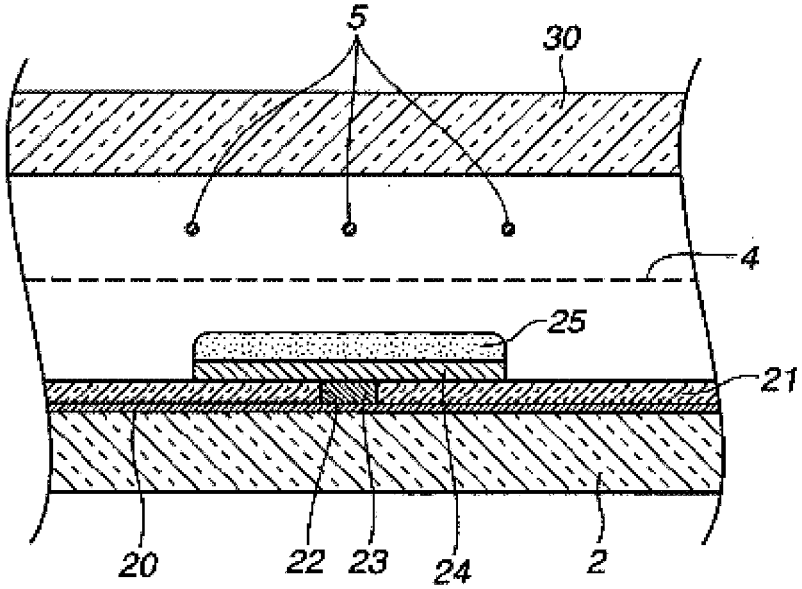
FIG. 23 is an enlarged side cross-sectional view partially illustrating a fluorescent display tube on which conventional filament cathodes are mounted.

As shown in FIG. 20, a contact area to a tungsten core wire of a mono-layered ternary carbonate of 3.0 μm particles becomes smaller. However, by adopting a multi-layered structure, even the 3.0 μm particle ternary carbonate can be uniformly coated as shown in FIG. 21.

As described above, reducing the average grain size of the ternary carbonate can lead to uniformly coating the ternary carbonate on a tungsten core wire. Thus, a filament cathode with small power consumption can be obtained.

Moreover, the power consumed by the fluorescent display tube, which uses the filament cathodes, can be reduced.

Compared with the conventional carbonate of particles having a grain size of 6.5 to 7.5 μm, the electron emissive material layer having a thickness of 3 μm can reduce the cathode power consumption to 70% and the electron emissive material layer having a thickness of 2 μm can reduce the cathode power consumption to 60% and the electron emissive material layer having a thickness of 1 μm can reduce the cathode power consumption to 50%.

Reduction of the power consumption of a fluorescent display tube caused by using the filament cathodes of the present invention largely contributes to the recent trend of energy saving.

Moreover, the secondary effect of reducing the grain size of a carbonate to be coated is that gases (e.g. $CO_2$) produced during decomposition of carbonate can be reduced. This contributes to increasing the degree of vacuum inside the fluorescent display tube and to largely improving the reliability of the fluorescent display tube.

We claim:

1. A directly-heated oxide cathode comprising:

a core metal wire; and an electron emissive material layer formed on a surface of said core metal wire;

wherein said electron emissive material layer has a thickness of 0.5 μm to 4.0 μm.

2. A directly-heated oxide cathode as defined in claim 1, wherein said electron emissive material layer is formed of a solid solution formed of oxide crystal grains each having an average grain size of at least 0.1 μm to 2.0 μm.

3. A directly-heated oxide cathode as defined in claim 1, wherein said core metal wire comprises a tungsten core wire or a rhenium tungsten core wire.

4. A directly-heated oxide cathode comprising:

a core metal wire; and an electron emissive material deposited on a surface of said core metal wire;

wherein said electron emissive material is a solid solution formed of oxide crystal grains each having an average grain size of at least 0.1 μm to 2.0 μm.

5. A directly-heated oxide cathode as defined in claim 4, wherein said electron emissive material comprises a ternary oxide formed of at least barium, strontium and calcium.

6. A directly-heated oxide cathode as defined in claim 4, wherein said electron emissive material comprises a ternary oxide in which the weight ratio of barium (Ba), strontium (Sr) and calcium (Ca) is at least Ca:Sr:Ba=(5 to 25):(25 to 60):(30 to 60).

7. A directly-heated oxide cathode as defined in claim 4, wherein said core metal wire comprises a tungsten core wire or a rhenium tungsten core wire.

8. A directly-heated oxide cathode comprising:

a core metal wire; and an electron emissive material deposited on a surface of said core metal wire;

wherein said electron emissive material is formed of oxide crystal grains formed of carbonate particles each having an average grain size of at least 0.1 μm to 2.0 μm.

9. A directly-heated oxide cathode as defined in claim 8, wherein said core metal wire comprises a tungsten core wire or a rhenium tungsten core wire.

10. A directly-heated oxide cathode as defined in claim 8, wherein said electron emissive material comprises a ternary oxide formed of at least barium, strontium and calcium.

11. A directly-heated oxide cathode as defined in claim 8, wherein said electron emissive material comprises a ternary oxide in which the weight ratio of barium (Ba), strontium (Sr) and calcium (Ca) is at least Ca:Sr:Ba=(5 to 25):(25 to 60):(30 to 60).

12. A fluorescent display tube including as a thermionic source a directly-heated oxide cathode as defined in claim 1.

13. A fluorescent display tube as defined in claim 12, wherein said electron emissive material layer is formed of a solid solution formed of oxide crystal grains each having an average grain size of at least 0.1 μm to 2.0 μm.

14. A fluorescent display tube as defined in claim 12, wherein said core metal wire comprises a tungsten core wire or a rhenium tungsten core wire.

15. A fluorescent display tube including as a thermionic source a directly-heated oxide cathode as defined in claim 2.

16. A fluorescent display tube as defined in claim 15, wherein said electron emissive material comprises a ternary oxide formed of at least barium, strontium and calcium.

17. A fluorescent display tube as defined in claim 15, wherein said electron emissive material comprises a ternary oxide in which the weight ratio of barium (Ba), strontium (Sr) and calcium (Ca) is at least Ca:Sr:Ba=(5 to 25):(25 to 60):(30 to 60).

18. A fluorescent display tube as defined in claim 15, wherein said core metal wire comprises a tungsten core wire or a rhenium tungsten core wire.

19. A fluorescent display tube including as a thermionic source a directly-heated oxide cathode as defined in claim 3.

20. A fluorescent display tube as defined in claim 19, wherein said core metal wire comprises a tungsten core wire or a rhenium tungsten core wire.

21. A fluorescent display tube as defined in claim 19, wherein said electron emissive material comprises a ternary oxide formed of at least barium, strontium and calcium.

22. A fluorescent display tube as defined in claim 19, wherein said electron emissive material comprises a ternary oxide in which the weight ratio of barium (Ba), strontium (Sr) and calcium (Ca) is at least Ca:Sr:Ba=(5 to 25):(25 to 60):(30 to 60).

* * * * *